US010751853B2

(12) United States Patent
Haramboure et al.

(10) Patent No.: US 10,751,853 B2
(45) **Date of Patent: *Aug. 25, 2020**

(54) SAND BLASTER WITH REDUCED VIBRATION AND WEAR

(71) Applicant: AMERICAN FAB, INC., Travelers Rest, SC (US)

(72) Inventors: Mario Haramboure, Travelers Rest, SC (US); Ken Hedrick, Travelers Rest, SC (US); Bobby L Hawkins, Travelers Rest, SC (US); Reinhold Schliesseit, Greer, SC (US)

(73) Assignee: AMERICAN FAB, INC., Travelers Rest, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/850,052

(22) Filed: Dec. 21, 2017

(65) Prior Publication Data

US 2018/0147696 A1 May 31, 2018

Related U.S. Application Data

(62) Division of application No. 13/761,381, filed on Feb. 7, 2013, now Pat. No. 9,849,559.

(60) Provisional application No. 61/696,335, filed on Sep. 4, 2012.

(51) Int. Cl.

| | |
|---|---|
| ***B24C 3/06*** | (2006.01) |
| ***B24C 7/00*** | (2006.01) |
| ***B24C 5/04*** | (2006.01) |
| ***B24C 9/00*** | (2006.01) |

(52) U.S. Cl.

CPC ..... *B24C 3/06* (2013.01); *B24C 5/04* (2013.01); *B24C 7/0053* (2013.01); *B24C 7/0084* (2013.01); *B24C 9/00* (2013.01)

(58) Field of Classification Search

None

See application file for complete search history.

(56) References Cited

U.S. PATENT DOCUMENTS

| | | | | |
|---|---|---|---|---|
| 2,678,520 A * | 5/1954 | Jewett | B24C 9/00 | 451/89 |
| 5,312,040 A * | 5/1994 | Woodward | B05B 15/55 | 239/1 |
| 5,816,129 A * | 10/1998 | Singer | B27B 27/06 | 83/468.3 |
| 5,862,985 A * | 1/1999 | Neibrook | B05B 1/1636 | 239/428.5 |
| 6,224,000 B1 * | 5/2001 | Wang | A62C 31/03 | 239/390 |
| 2006/0104825 A1 * | 5/2006 | Etter | F04B 35/06 | 417/234 |

* cited by examiner

*Primary Examiner* — Brian D Keller

(74) *Attorney, Agent, or Firm* — Bennett Mullinax, LLC

(57) ABSTRACT

A sand blaster is provided that includes an engine carried by an engine mounting plate. A frame is included and an engine support isolator engages the frame and carries the engine mounting plate. The engine support isolator has a stud that extends through a first coil and a stud guide that has a tapered inner surface. The stud extends through the stud guide. In other arrangements an air regulator that is adjustable is provided, and a nozzle that features reduced wear is provided.

6 Claims, 19 Drawing Sheets

SAND BLASTER WITH REDUCED VIBRATION AND WEAR

RELATED APPLICATIONS

This application claims the benefit of U.S. Provisional Application Ser. No. 61/696,335, filed Sep. 4, 2012 and which is incorporated herein by reference.

FIELD OF THE INVENTION

The present invention relates generally to a sand blaster with reduced wear and vibration features. More particularly, the present application involves a sand blaster that may include, an adjustable air regulator, an engine support isolator, an air/sand mixing chamber, a pressure washer conversion, and a nozzle that features reduced wear.

BACKGROUND

Sand blasting is a blasting technique that applies sand at a high velocity against a surface to effect a change in the surface. The sand can be used to smooth a rough surface, roughen a smooth surface, or remove objects from the surface. Sand blasters generally include a hopper into which sand is located and a pressure source that pulls sand from the hopper. The sand is transferred to a gun that can be actuated by the user to dispense the sand through a nozzle of the gun and against the surface. The gun can be actuated by the user through the pulling of a trigger. Although capable of causing the gun to actuate to release sand, sand blasters are generally not adjustable in that one cannot regulate the amount of sand that is being dispensed from the sand blaster at any given time. As such, more sand may be released at a given time than is desired to be released by the user when using the sand blaster.

Sand blasters employ engines and pumps that function to generate the high pressures needed for dispensing the sand at a velocity that can wear away the surface or objects located on the surface. Unfortunately, the operation of the engine and pump creates vibrations that can in turn be transferred to the hopper as the hopper, engine and pump are attached to the same frame. Excessive vibration of the hopper will prevent the sand within the hopper from being pulled through the sand blaster and dispensed from the nozzle. This situation will reduce the effectiveness of the sand blasting operation.

Sand transferred through the pressure washer will cause the internal portions of the pressure washer to degrade as the sand is an abrasive substance. As the sand flows through the nozzle, it will contact the interior surfaces of the nozzle and wear it down creating an undesired larger opening size. Such wear will result in decreased performance and eventual part replacement. Although sand blasters are known for use in cleaning surfaces, challenges exist in their design and operation that shorten lifespan and reduce functionality. As such, there remains room for variation and improvement within the art.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended FIGS. in which.

Figure 1:
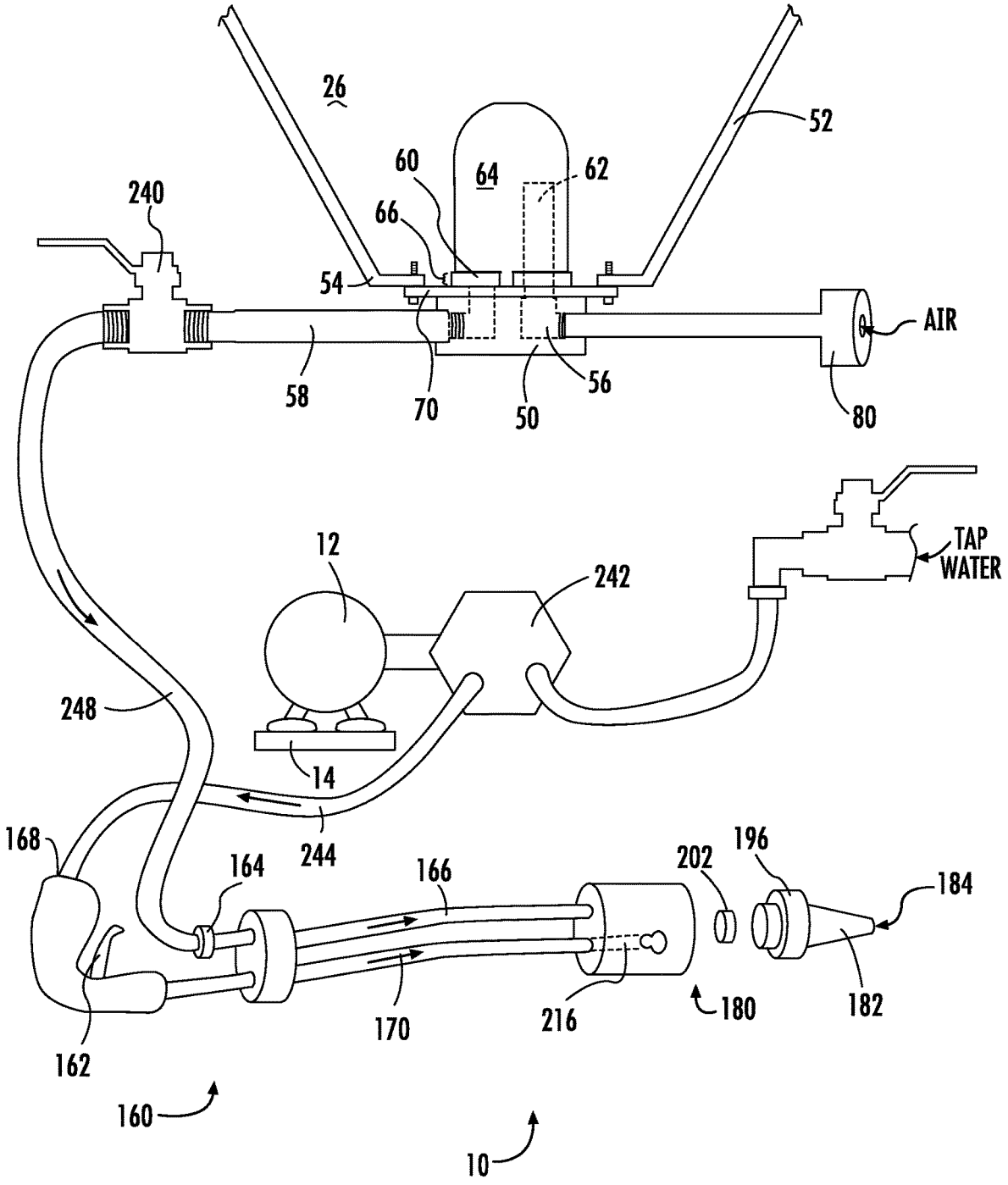
FIG. 1 is a schematic view of a sand blaster and related components in accordance with one exemplary embodiment.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for a sand blaster 10 that allows one to regulate the amount of sand 26 that is dispensed from the sand blaster 10 so that varying amount of sand 26 can be used for jobs of different scope. Further, the present sand blaster 10 is arranged so that reduced vibration is imparted to an air sand mixer 50 of the sand blaster 10. Reduction of vibration to this element may more easily allow sand 26 to flow through the sand blaster 10 so that the sand 26 is always available for dispensing. The present invention may also provide for a nozzle 180 of the sand blaster 10 from which the sand 26 and water are dispensed. The nozzle 180 may be provided in a construction that reduces or eliminates wear on components of the nozzle 180 that occurs due to sand 26 flow through the nozzle 180.

With reference now to FIG. 1, a partial schematic view of the sand blaster 10 is illustrated. Although reference will be made back to FIG. 1 throughout the description of the sand blaster 10, a general overview of the sand blaster 10 shows an air regulator 80 through which air is directed into an air sand mixer 50 in which the air and sand 26 are mixed and then transferred through an air sand conduit 58 and an air sand line 248 to a gun 160 for dispensing from the nozzle 180. Water is pumped via a pump 242 and an engine 12 and is transferred under pressure through a water line 244 to the gun 160 also for dispensing from the nozzle 180. The air and sand 26 are mixed with the water in the nozzle 180 from which, all three of these components are dispensed in a mixed state. The air and sand 26 are drawn through the system by way of a pressure drop or pressure vacuum provided by the fast flowing of water through the nozzle 180. As such, the high velocity flow of the water functions to draw the air and sand 26 through the sand blaster 10 for subsequent dispensing from the nozzle 180. The sand blaster 10 may be arranged so that a pump is not present to push the air and/or sand 26 through the sand blaster 10. Instead, pressure from the water pump 242 functions to draw the air and sand 26 through the sand blaster. This arrangement avoids the need for a separate pump to move sand through the apparatus.

Figure 2:
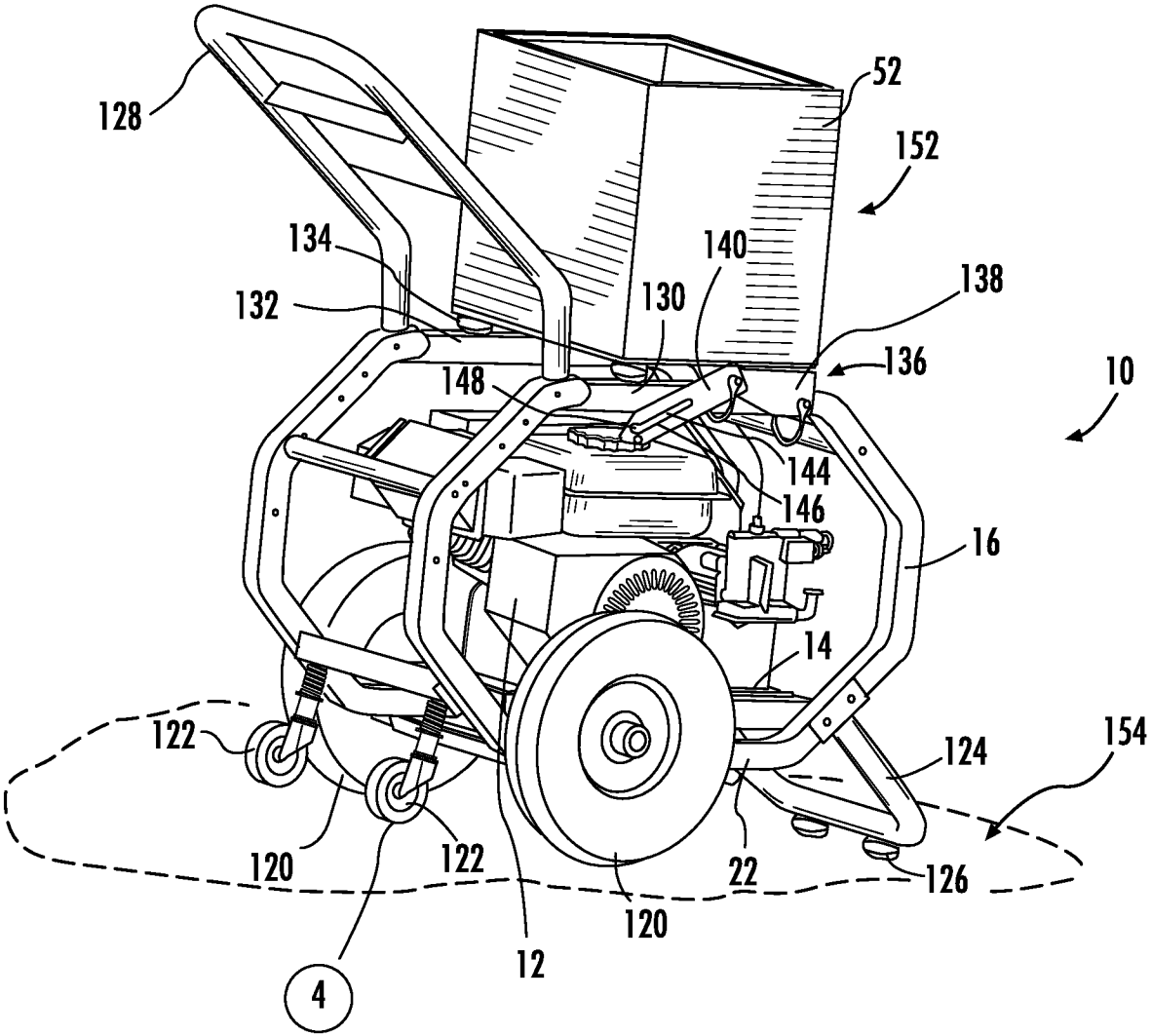
FIG. 2 is a back side perspective view of a sand blaster.

The sand blaster 10 is shown in perspective view in FIG. 2. Here, the sand blaster 10 includes a frame 16 that has a handle 128 for grasping by the user and a pair of main wheels 120 that render the sand blaster 10 mobile. When the sand blaster 10 is moved to a desired location it can be arranged so that a forward bracing member 124 with cushions 126 engage the ground 154. The cushions 126 can be made of an elastic material so that they minimize vibrations of the frame 16 in that they dampen vibrations coming from the frame 16 or from the ground 154. The main wheels 120 will also engage the ground 154 when the sand blaster 10 is positioned in this manner. If the user should pull the handle 128 backwards or otherwise tip the sand blaster 10 so that the forward bracing member 124 is lifted off of the ground 154, a pair of counter balancing wheels 122 extend from the frame 16 and can engage the ground 154 to prevent tilting or further movement of the sand blaster 10 and to stabilize its position on the ground 154. The counter balancing wheels 122 can have a dampening member such as a spring that functions to absorb the impact of the counterbalancing wheels 122 with the ground 154 to minimize the force of this engagement should the sand blaster 10 be tipped.

Figure 3:
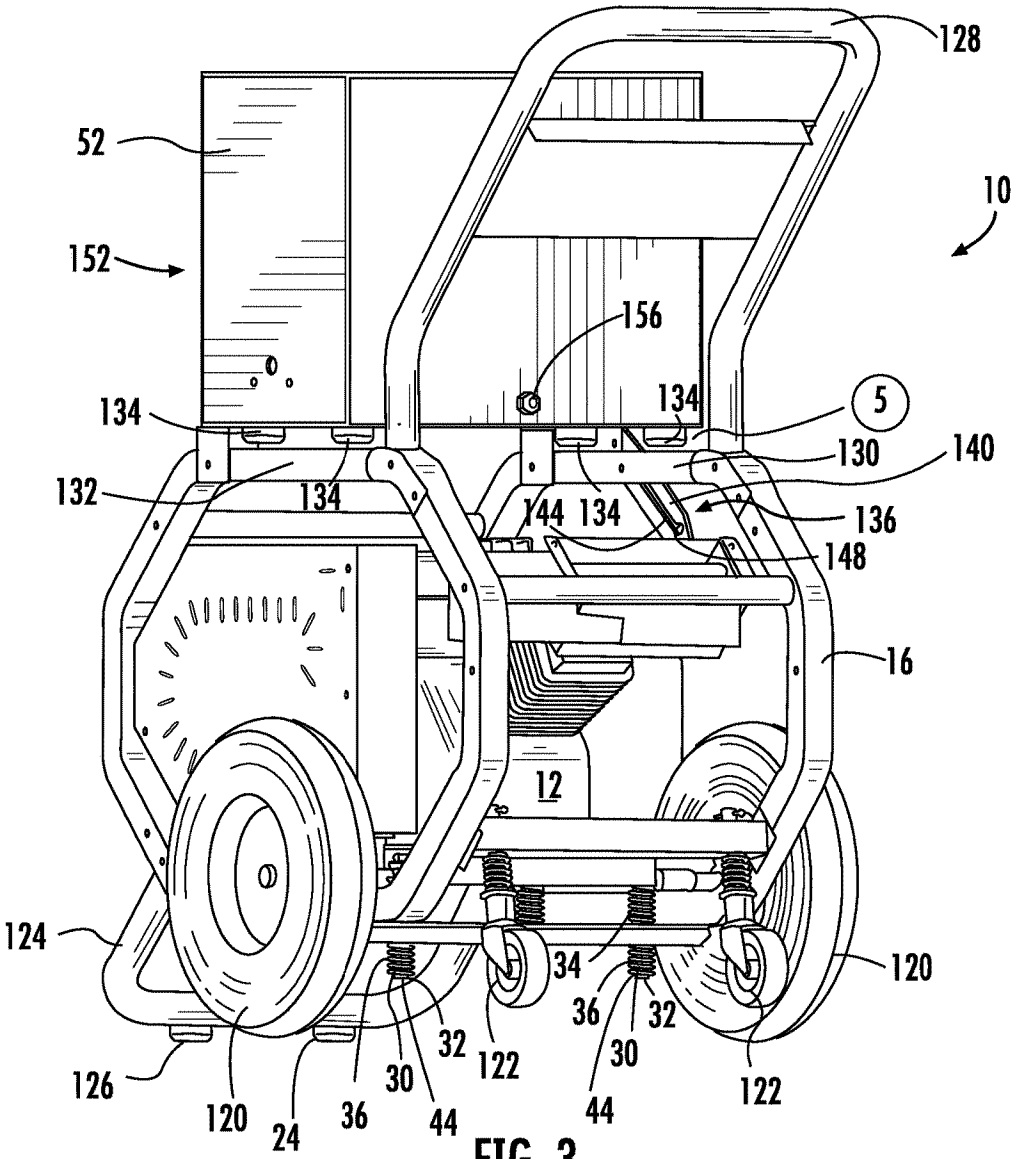
FIG. 3 is a back perspective view of the sand blaster of FIG. 2.

The engine 12 is located generally in the center of the frame 16 and will produce vibrations when running. The top portion of the frame 16 has a pair of upper longitudinal bars 130 and 132 that have flat upper surfaces. The hopper 52 is located above the upper longitudinal bars 130 and 132. As stated, vibration from the engine 12 may be transferred to the hopper 52 and cause sand 26 within the hopper 52 from being pulled therefrom and through the sand blaster 10 so that it is not dispensed. In order to help minimize vibration to the sand 26 in the hopper 52, several elastic isolators 134 are located between the bottom of the hopper 52 and the upper surfaces of the upper longitudinal bars 130 and 132. FIG. 3 is a back, perspective view of the sand hopper 10 and shows the arrangement of these elastic isolators 134 in greater detail. A pair of elastic isolators 134 are spaced from one another in the longitudinal direction and are attached to the bottom surface of the hopper 52 and engage the upper surface of the upper longitudinal bar 130. Another pair of elastic isolators 134 are attached to the bottom surface of the hopper 52 and are spaced from one another in the longitudinal direction and engage the upper surface of the upper longitudinal bar 132. The elastic isolators 134 dampen vibrations from the longitudinal bars 130 and 132 that are present due to the engine 12 and function to vibrationally isolate the hopper 52 and components associated with the hopper 52 such as the air sand mixer 50 and air regulator 80. The elastic isolators 134 may completely or partially dampen vibrations to the hopper 52 and associated components from the frame 16. As discussed, excessive vibration of the hopper 52 may prevent sand 26 from being properly introduced into the air stream and subsequently dispensed from the sand blaster 10.

Figure 4:
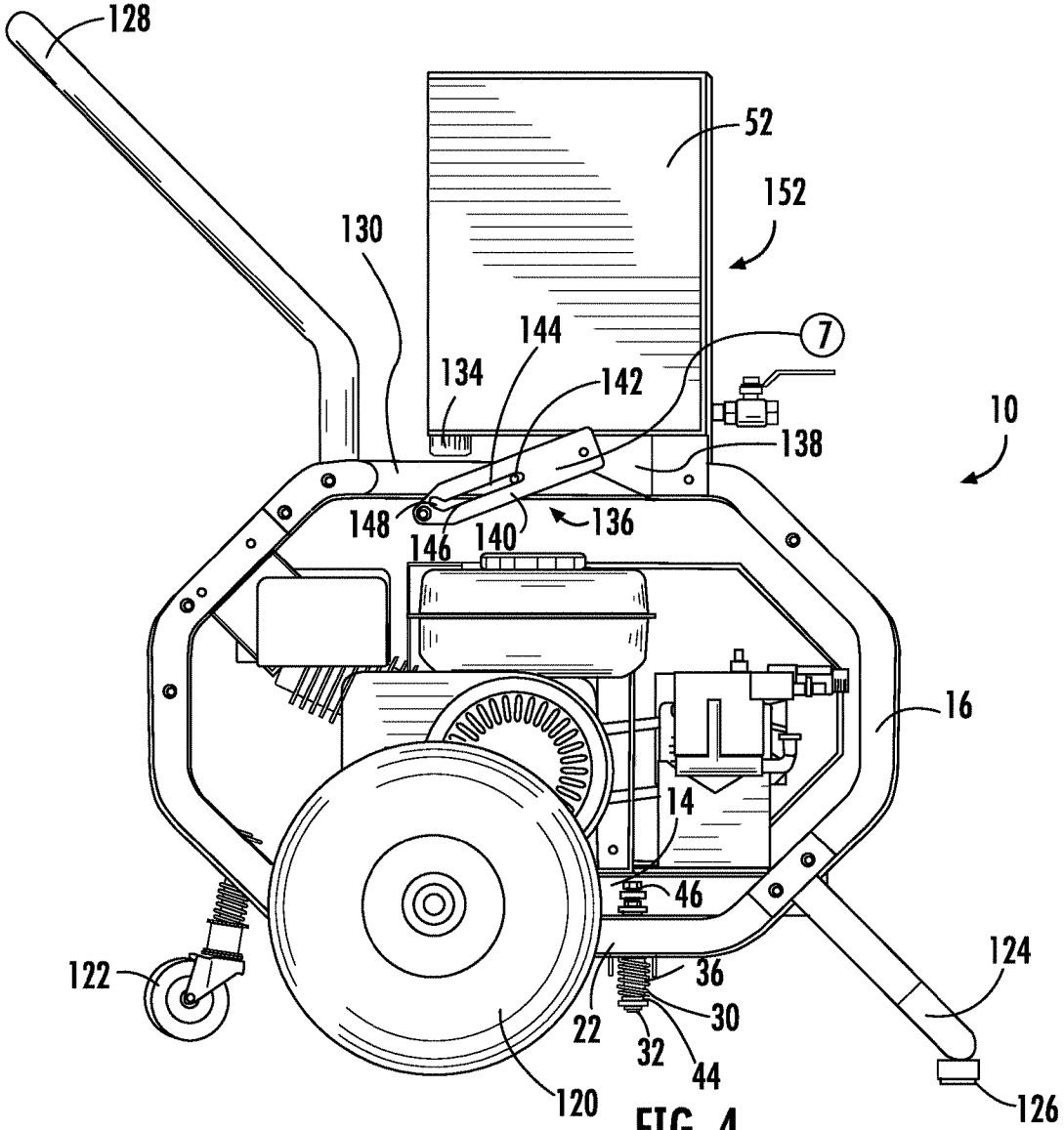
FIG. 4 is a right side view of a sand blaster with a hopper in a non-tilted position.

FIG. 4 is a side view of the sand blaster 10 and shows the hopper 52 located above the upper longitudinal bars 130 and 132. Due to the location of the hopper 52, it may be difficult for one to access the engine 12 or other components of the sand blaster 10 through the top of the frame 16. A sliding hinge 136 is provided to allow the hopper 52 to be tilted relative to the frame 16 to then allow one to access portions of the sand hopper 10 within the frame 16 through the top of the frame 16. The sliding hinge 136 has a first member 138 that is pivotally attached to the frame 16 at the side of the upper longitudinal bar 130. The first member 138 can be rigidly attached to the hopper 52 or air sand mixer 50. In some embodiments the first member 138 is rigidly attached to a bottom plate 54 of the hopper 52. Pivotal movement of the first member 138 causes a corresponding pivotal movement of the hopper 52 relative to the frame 16. A second member 140 is also included and is pivotally attached to the first member 138. The second member 140 has a slot 144 that has a linear extending portion 146 and an angled portion 148 that extends from the linear expending portion 146. A pin 142 extends from the side of the upper longitudinal bar 130 and is disposed within the slot 144 and in particular within the linear extending portion 146 of the slot 144. The hopper 52 is in the non-tilted position 152 in FIG. 4 and the pin 142 is at the end of the linear extending portion 146.

Figure 5:
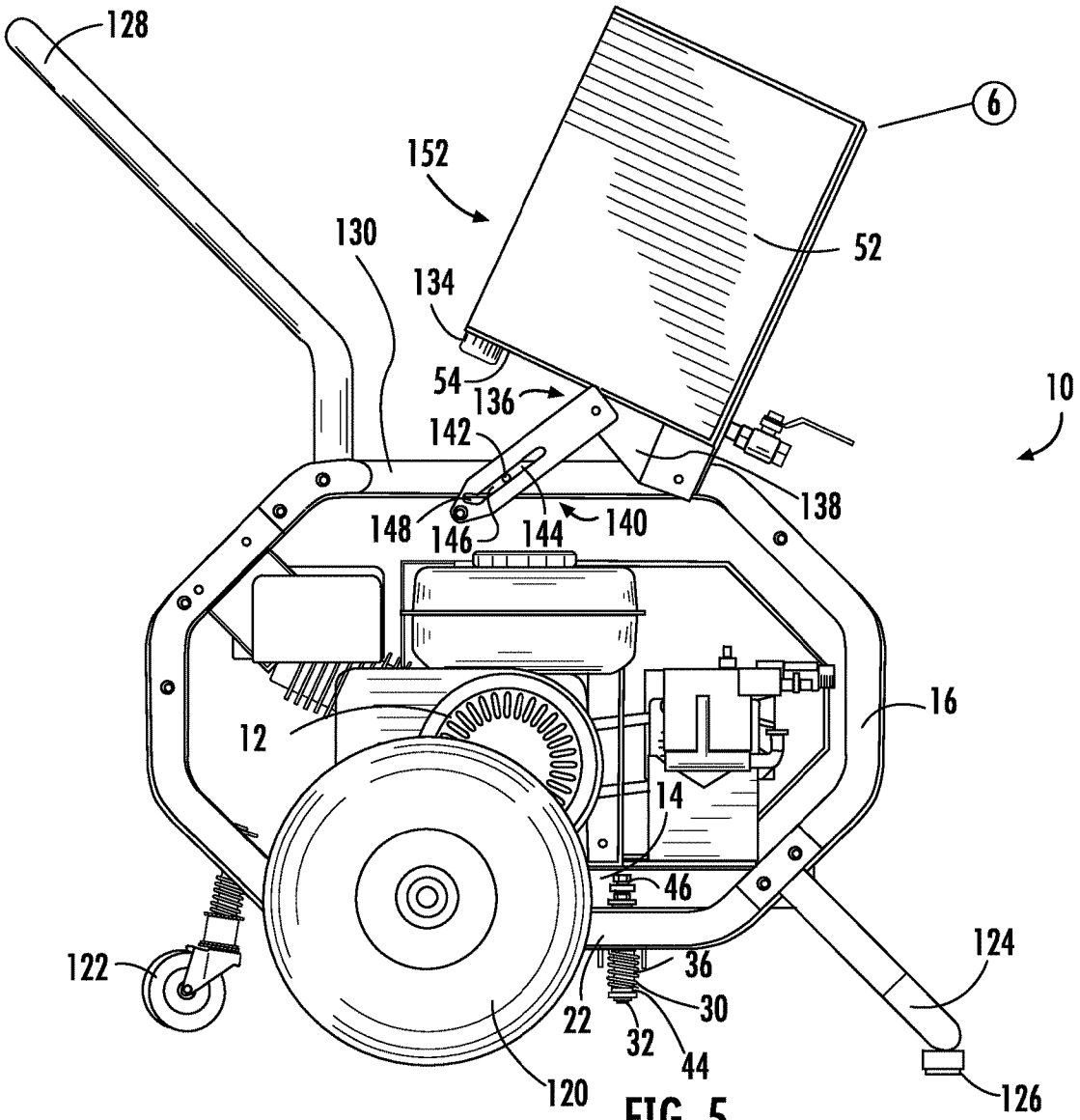
FIG. 5 is a right, side view of the sand blaster of FIG. 3 with the hopper in a tilted position.

The user may push the hopper 52 when he or she desires access to the interior components of the sand blaster 10 through the top of the frame 16. The user can simply apply force with his or her hands to cause the hopper 52 to be tilted from the non-tilted position 152 to a tilted position 150 as shown for example in FIG. 5. The pin 142 will slide within the linear extending portion 146 of the slot 144 and the hopper 52 and associated components such as the air sand mixer 50 and the air regulator 80 will be in turn tilted with respect to the frame 16. The top of the frame 16 will be open for the user to access portions of the sand blaster 10 within the frame 16. The hopper 52 could in fact be tilted farther than the position shown in FIG. 5 such that at full tilt the pin 142 will be within the angled portion 148 and thus be at full tilt. Positioning the pin 142 within the angled portion 148 may cause a locking of the pin 142 to in turn cause the hopper 52 to be somewhat locked in place in the full tilt position thus requiring some degree of force to be imparted by the user to push the hopper 52 back into the non-tilted position 152.

The sand blaster 10 may be provided with one or more engine support isolators 30 that function to reduce vibration in the sand blaster 10. In this regard, the engine support isolators 30 will absorb or damped vibration from the engine 12 so that this vibration is not transferred to other parts of the sand blaster, such as the air sand mixer 50 and hopper 52.

Figure 6:
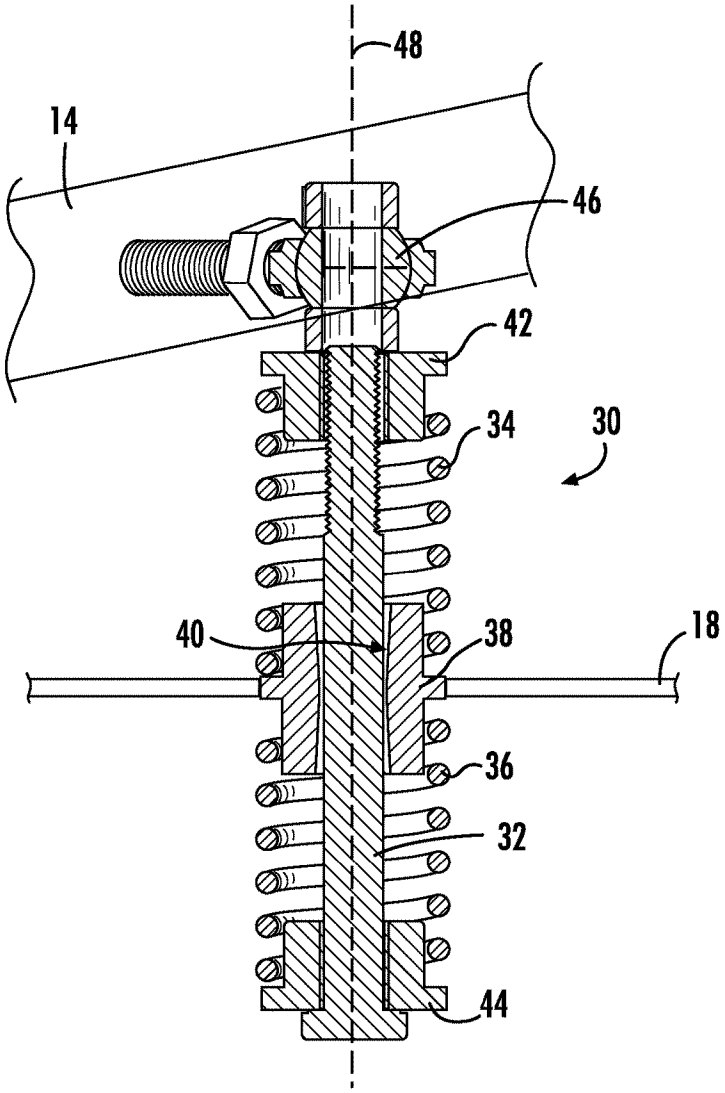
FIG. 6 is a cross-sectional view of an isolator.

The engine support isolator 30 can function to reduce some or all of transfer of vibration from the engine 12 or other components of the sand blaster 10. Although described as isolating the vibrations of the engine 12, the engine support isolator 30 may be used to reduce or isolate vibrations of any member or members of the sand blaster 10. A cross-sectional view of the engine support isolator 30 is shown with reference to FIG. 6. The engine support isolator 30 may include a mounting plate attachment member 46 that is rigidly attached to an engine mounting plate 14 by way of a bolted connection. The mounting plate attachment member 46 can pivot about a longitudinal axis 48 or may be a rigid component in other exemplary embodiments. Although shown as employing a bolted connection, the mounting plate attachment member 46 can be attached to the engine mounting plate 14 in a variety of manners in accordance with other exemplary embodiments.

A stud guide, that may be an intermediate stud guide 38, is open through its center and has a longitudinal axis 48 that extends through its center. A stud 32 extends completely through the opening of the intermediate stud guide 38 and is coaxial with the longitudinal axis. An upper stud guide 42 is present and the stud 32 may extend through the upper stud guide 42. The upper stud guide 42 may be capable of moving with respect to member 46 and may engage the member 46. The stud 32 can be rigidly attached to the mounting plate attachment member 46 through a threaded engagement. A first coil 34 extends from the upper stud guide 42 to the intermediate stud guide 38 and may engage both of these members. Force, such as vibrational forces, acting on the engine mounting plate 14 are transferred into the mounting plate attachment member 46 which in turn may cause a compression of the first coil 34 through the engagement with the upper stud guide 42. The first coil 34 may function to absorb this force and dampen same through its compression and bias back.

The stud 32 extends completely through a lower stud guide 44 and has a flange that engages the bottom surface of the lower stud guide 44 to prevent the stud 32 from being withdrawn through the lower stud guide 44 from bottom to top. A second coil 36 is between and engages both the lower stud guide 44 and the intermediate stud guide 38. Forces on the mounting plate attachment member 46 are transferred to the stud 32 that in turn act on the lower stud guide 44 to draw the lower stud guide 44 upwards. This will cause compression to the second coil 36 and dampening of the force as the second coil 36 will absorb the force and in turn act against the force to push the lower stud guide 44 and engaged stud 32 back down. As such, the second coil 36 and lower stud guide absorb vibrational forces from upward movement of the stud 32 but do not dampen forces causing downward movement of the stud 32. Likewise, the first coil 34 and the upper stud guide 42 absorb vibrational forces from downward movement of the stud 32 and/or mounting plate attachment member 46 but do not dampen forces from upward movement of these components. The coils 34 and 36 thus dampen vibrational forces generated at the engine 12 and isolate or minimize these forces to in turn prevent or minimize vibration of other components of the sand blaster 10 such as the hopper 52 or air sand mixer 50.

The intermediate stud guide 38 may or may not engage the first and second coils 34 and 36. In some instances the first and second coil 34 and 36 may engage the frame 16 or other component. The intermediate stud guide 38 may be rigidly attached to the engine mounting plate support. The intermediate stud guide 38 has an inner surface 40 that is a dual tapered inner surface. In this regard, in the direction along the longitudinal axis 48 the circumference of the inner surface 40 will narrow to a certain point and then will expand from this certain point. The entire inner surface 40 is dual tapered in the embodiment shown in FIG. 6, but in other arrangements the inner surface 40 need not be arranged in this manner.

When no forces are imparted onto the stud 32, a longitudinal axis of the stud 32 will, be coaxial with the longitudinal axis 48 of the intermediate stud guide 38. When vibrational forces are imparted onto the stud 32, the longitudinal axis of the stud 32 may move out of alignment with the longitudinal axis 48. This misalignment may be a wobbling of the stud 32 such that it in effect pivots within the interior of the intermediate stud guide 38. The dual tapered inner surface 40 accommodates this wobbling or misalignment such that the stud 32 is both guided by the intermediate stud guide 38 and allowed enough play to wobble within the intermediate stud guide 38. The coils 34 and 36 may also have enough flexibility to accommodate this wobbling or rocking of the stud 32 when vibration is imparted onto the stud 32. The stud 32 can rotate within the intermediate stud guide 38 and the intermediate stud guide 38 allows this rotation.

Figure 7:
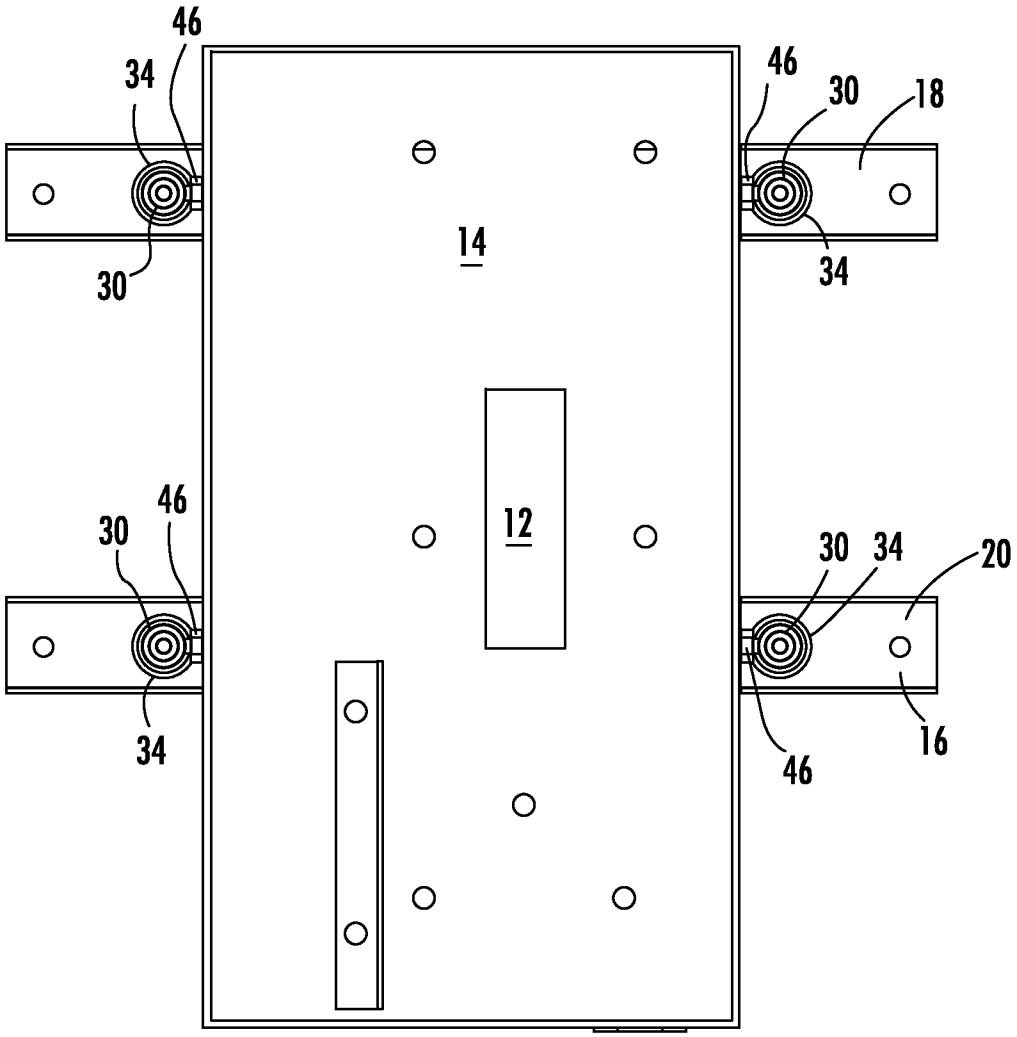
FIG. 7 is a top view of an engine mounting plate and isolators.

One arrangement of the engine mounting plate 14 and engine support isolators 30 is shown with reference to FIG. 7. Here, the frame 16 has a lateral bar 18 and a lateral bar 20 that are spaced from one another in the longitudinal direction. Four engine support isolators 30 are present. Two isolators 30 have intermediate stud guides 38 that are rigidly attached to the lateral bar 20, and the other two isolators 30 have intermediate stud guides 38 that are rigidly attached to the lateral bar 18. The engine 12 rests on the engine mounting plate 14, and all four engine support isolators 30 directly engage the engine mounting plate 14.

Figure 8:
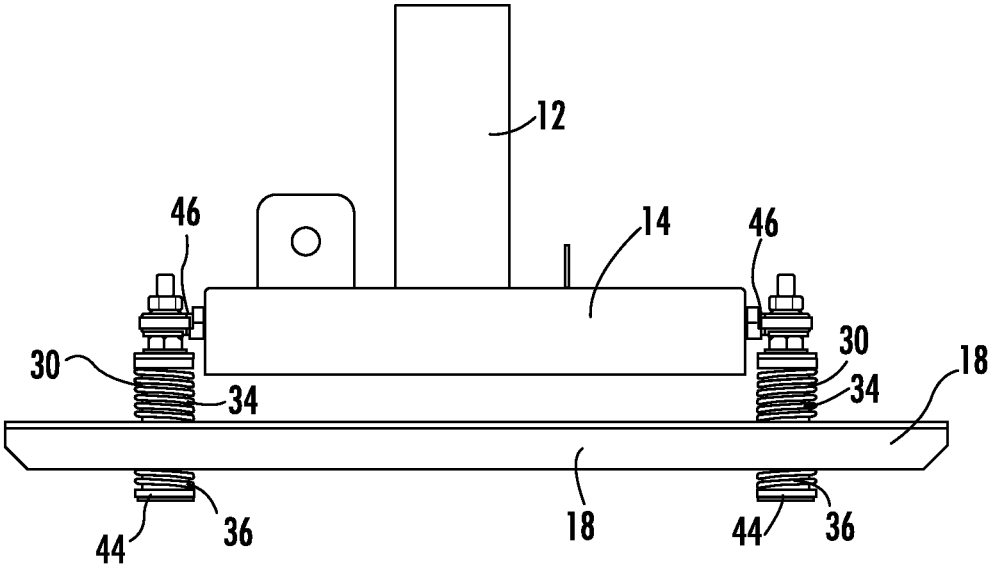
FIG. 8 is a front view of an engine mounting plate and isolators.
Figure 9:
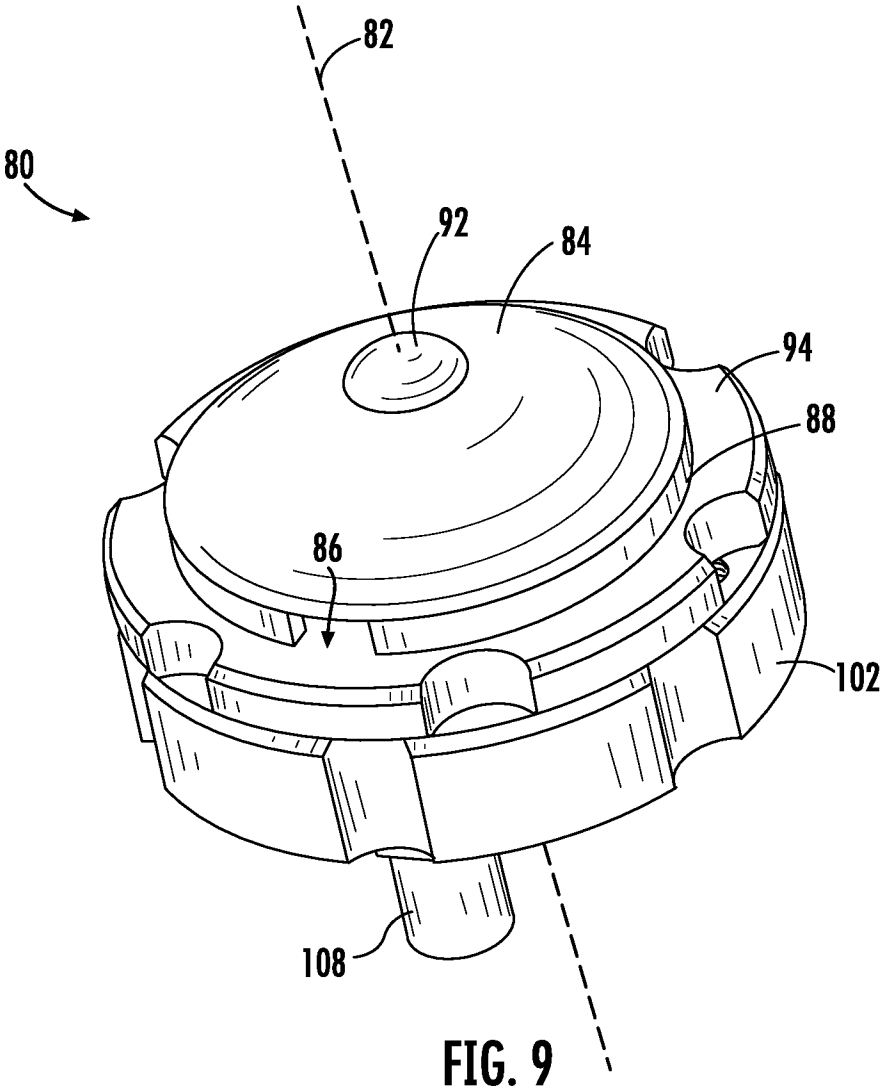
FIG. 9 is a perspective view of an air regulator.
Figure 10:
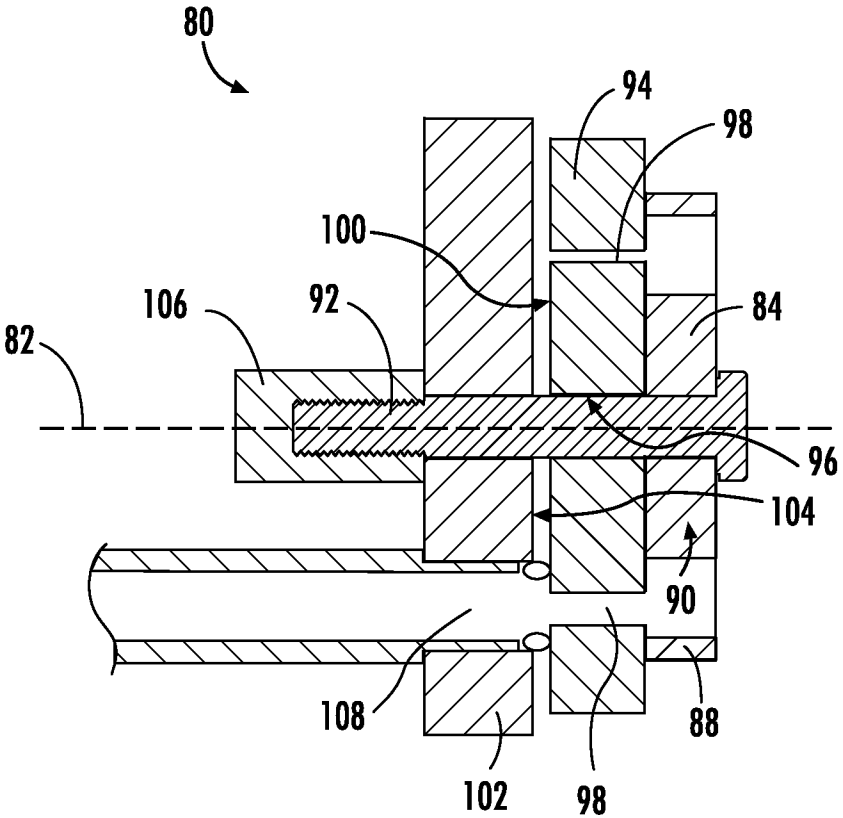
FIG. 10 is a cross-sectional view of the air regulator of FIG. 9
Figure 11:
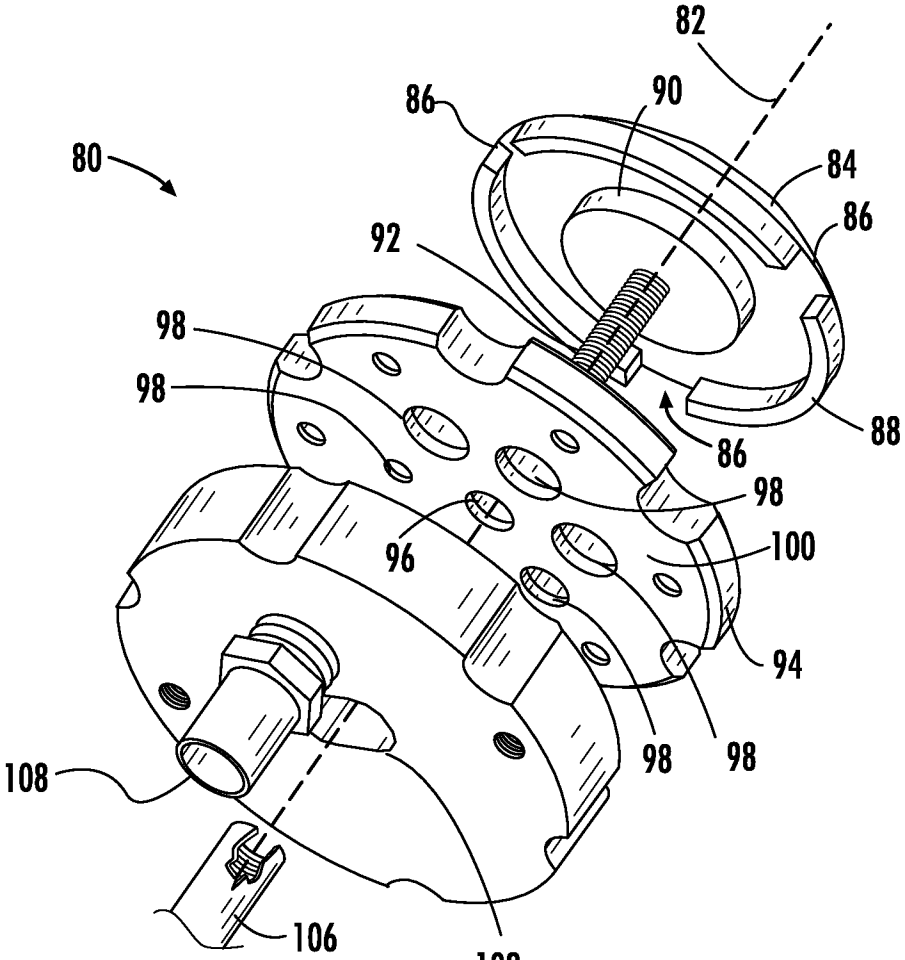
FIG. 11 is an exploded bottom perspective view of the air regulator of FIG. 9.
Figure 12:
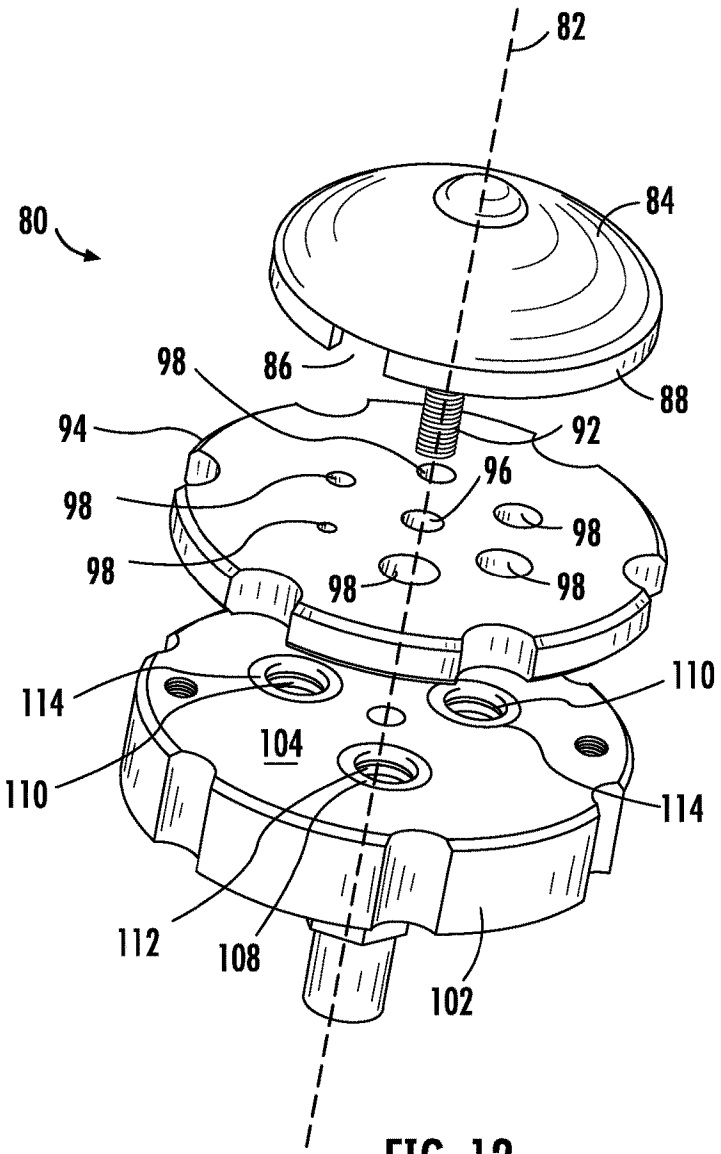
FIG. 12 is an exploded top perspective view of the air regulator of FIG. 9.

With reference now to FIG. 8, the engine support isolators 30 are located partially above and partially below the lateral bars 18 and 20. The engine mounting plate 14 is located so that two of the isolators 30 are on one side, and so that the other two isolators 30 are on the other side. This arrangement of the isolators 30 and the engine mounting plate 14 is only one of many possible embodiments. For example, instead of directly engaging the engine mounting plate 14, the mounting plate attachment members 46 may indirectly engage the engine mounting plate 14. Other components of the sand blaster 10 may be, located between the mounting plate attachment members 46 and the engine mounting plate 14. In this regard, the engine mounting plate 14 will still be carried by the isolators 30 and its vibration will be isolated or reduced but it will not directly engage any portion of the engine support isolators 30.

With reference back to FIGS. 3 and 4, the sand blaster 10 does not include the lateral bars 18 and 20. Instead, the lower portion of the frame 16 includes a lower longitudinal bar 22 and a lower longitudinal bar 24. Four engine support isolators 30 are again employed in which two of them have intermediate stud guides 38 that are rigidly attached to the lower longitudinal bar 22 and the other two have intermediate stud guides that are rigidly attached to the lower longitudinal bar 24. The mounting plate attachment members 46 are rigidly attached to the sides of the engine mounting plate 14. This arrangement will again function to isolate and dampen the vibration from the engine 12 to prevent it from being transferred to certain other components of the sand blaster 10.

The air regulator 80 is shown in FIGS. 9-12 and is made of three main parts: a cover 84, intermediate member 94, and base 102 that are coaxial about longitudinal axis 82. A male threaded bolt 92 is also coaxial about longitudinal axis 82 and functions to hold the three main components 84, 94 and 102 together. The air regulator 80 permits airflow into the sand blaster 10 that is mixed with the sand 26 that is eventually dispensed. The air regulator 80 is adjustable so that the amount of air entering can be increased or decreased, and hence the amount of sand 26 that is eventually dispensed can be increased or decreased.

The cover 84 has a side wall 88 that surrounds the circumference of the cover 84, and a plurality of air inlets 86 are defined through the side wall 88. Three air inlets 86 are present and are disclosed at 120 degree angles about the longitudinal axis 82. An interior wall 90 is present and is continuous about the entire longitudinal axis 82. Air will enter the cover 84 through the air inlets 86 and into the space defined between the interior wall 90 and the side wall 88.

The intermediate member 94 is disc shaped and its upper surface directly faces the lower surface of the cover 84. A center aperture 96 is defined through the intermediate member 94 and the male threaded bolt 92 extends completely through the center aperture 96. A plurality of air inlet apertures 98 are spaced from the center of the center aperture 96 in the radial direction. In the disclosed embodiment six air inlet apertures 98 are shown and they are all of different sizes and increase in size sequentially about the longitudinal axis 82. In other embodiments, two or more of the air inlet apertures 98 may be of the same size. Although shown as having six air inlet apertures 98, it is to be understood that from 1-5, from 7-10, from 11-15, or up to 50 air inlet apertures 98 may be present in accordance with other exemplary embodiments. The intermediate member 94 rotates relative to the base 102 and may rotate 360 degrees completely relative to the base 102. The intermediate member 94 may rotate relative to the cover 84 or may be rigidly attached to the cover 84 in various arrangements.

An upper surface 104 of the base 102 directly faces a lower surface 100 of the intermediate member 94. The male threaded bolt 92 extends through a center aperture of the base 102 and into a female threaded receiving portion 106 and is rigidly attached thereto via a threaded connection. The base 102 may be rigidly attached to the female threaded receiving portion 106 or the fastening of the male threaded bolt 92 may cause the base 102 to be secured to the female threaded receiving portion 106. An air outlet aperture 108 extends through the base 102. The user will align a desired one of the air inlet apertures 98 with the air outlet aperture 108 by rotating the intermediate member 94. Air will then have a flow path through the air inlets 86 into the cover 84 and through the aligned air inlet aperture 98 and into the air outlet aperture 108 and onward into the sand blaster 10.

A pair of dummy holes 110 are located in the base 102 and O-rings 114 are located in the dummy holes 110. The dummy holes 110 are present in order to aid in engagement and rotation of the lower surface 100 relative to the upper surface 104. The dummy holes 110 may provide proper cushion to the intermediate member 94 and the base 102. The air outlet aperture 108 has an O-ring 112 and it may function to effect a seal at the air outlet aperture 108 to prevent air leakage at this location. The O-rings 112 and 114 may engage the lower surface 100 and may function to aid in engagement of the lower surface 100 with the upper surface 104 and rotation of these two components relative to one another. The user may rotate the intermediate member 94 relative to the base 102 to align the desired air inlet aperture 98 so that a desired amount of air flow will flow through the air regulator 80. It may be the case that the alignment of a smaller air inlet aperture 98 with the air outlet aperture 108 will cause more sand to be released from the air sand mixer 50 and thus dispensed from the sand blaster 10.

Other arrangements of the air regular 80 are possible. For example, with reference to FIG. 3, a single piece air regulator 156 is included in place of the adjustable air regulator previously discussed. The single piece air regulator 156 has an aperture of a certain, size and air is drawn through the regulator 156 and into the sand blaster 10. If a different sized aperture is desired to modify the air flow and hence sand dispensing from the sand blaster 10, the user may unscrew the single piece air regulator 156 from the side of the hopper 52 and replace this component with another single piece air regulator that has a different sized aperture. In this regard, multiple single piece air regulators can be used to achieve adjustable air input.

Figure 13:
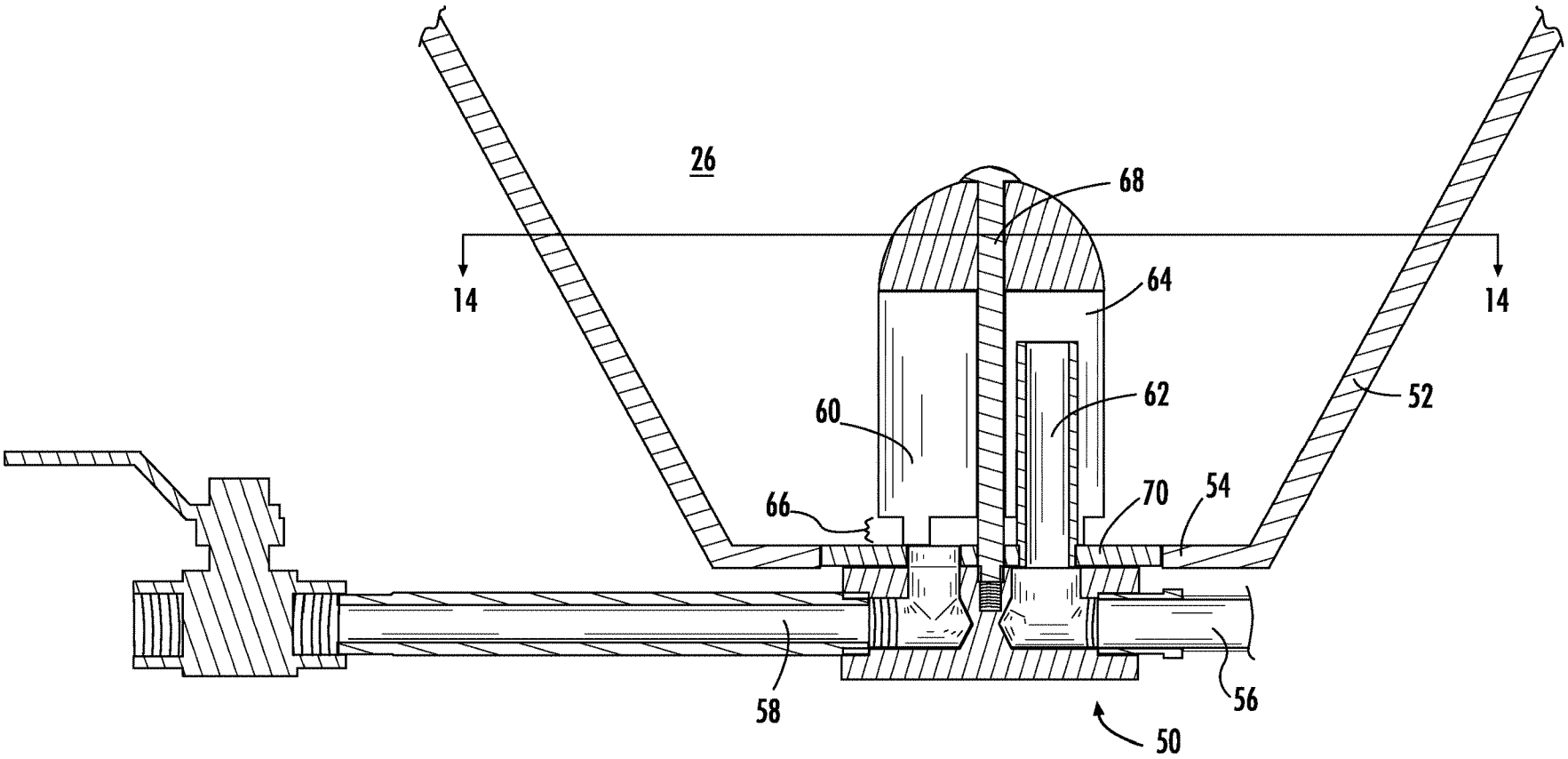
FIG. 13 is a side view of an air sand mixer.
Figure 14:
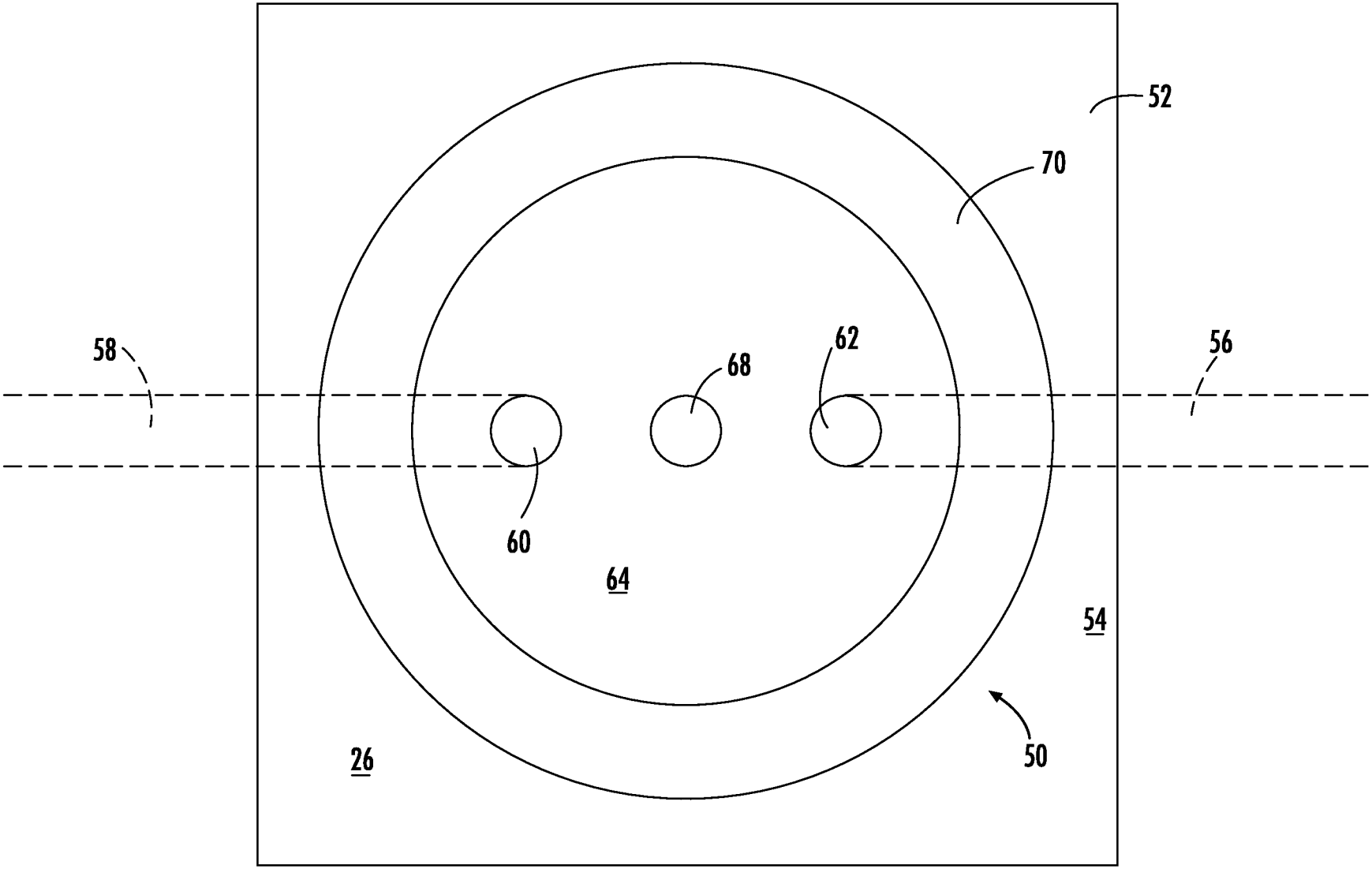
FIG. 14 is a cross-sectional view along line 14-14 of FIG. 13.

With reference back to FIG. 1, air flowing into and through the air regulator 80 will travel into an air inlet 56 of an air sand mixer 50. The air sand mixer 50 has a base 70 that can be rigidly attached to a bottom plate 54 of the hopper 52 through the use of bolts, a welded connection, or other manners of attachment. With reference to FIGS. 13 and 14, the air sand mixer 50 is shown in relation to the hopper 52. Sand 26 located in the hopper 52 will mix with air in the air sand mixer 50 and be transferred therefrom through an air sand conduit 58. Air enters the air sand mixer 50 via an air inlet 56 from the air regulator 80 and travels into a vertical conduit 62. A mixing chamber 64 is included and is dome shaped in the disclosed embodiment. The mixing chamber 64 can have a dome shaped top and a cylindrical side wall. Sand may surround the exterior of the mixing chamber 64 and can be located above the highest portion of the upper surface of the mixing chamber 64 and in effect the mixing chamber 64 can be buried in the sand 26. As illustrated, the outer perimeter of the mixing chamber 64 surrounds the vertical conduit 62 and an air sand opening 60. The mixing chamber 64 is spaced from a base 70 of the air sand mixer 50 by some amount. A gap 66 is present between the bottom of the mixing chamber 64 and the upper surface of the base 70. Sand 26 from the sand hopper 52 may enter past the outer perimeter of the mixing chamber 64 via this gap 66. Once inside the mixing chamber 64, the air entering through the vertical conduit 62 engages and mixes with this sand 26 and the combined air and sand 26 mixture is drawn through the air sand opening 60 via a negative pressure at this opening 60. The mixing chamber 64 is rigidly attached to the base 70 by way of a mounting stud 68 at, the center of the mixing chamber 64.

Figure 15:
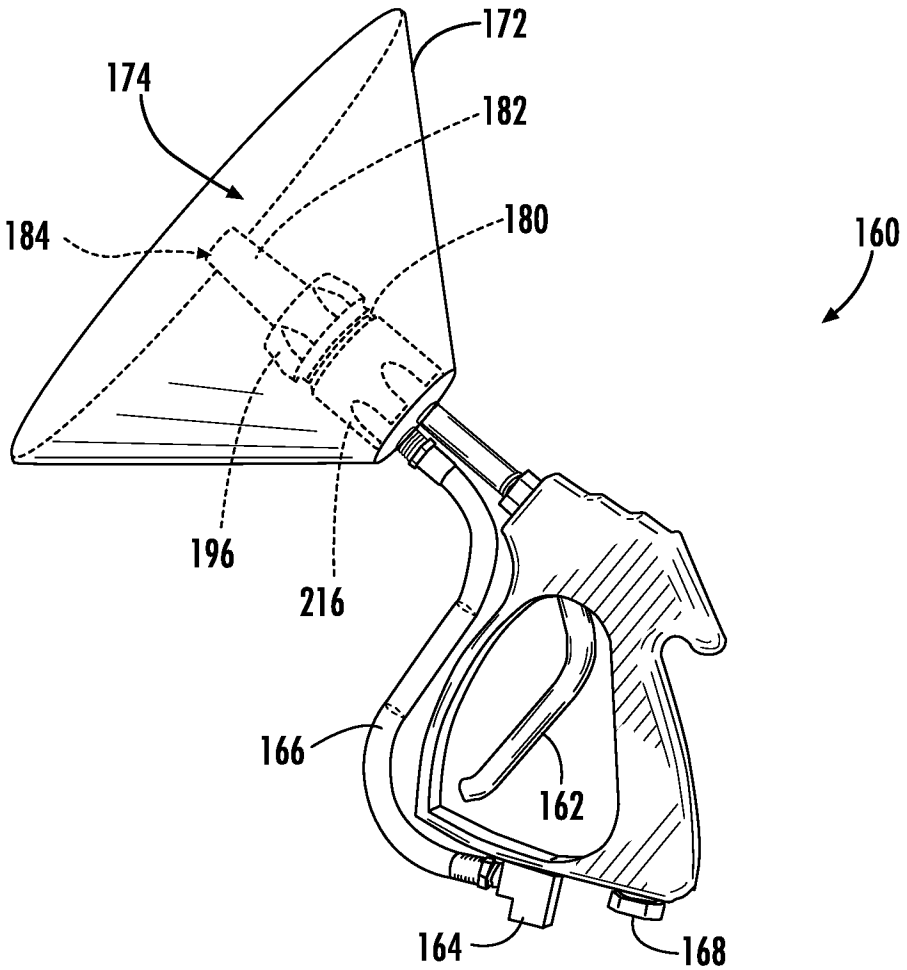
FIG. 15 is a perspective view of a gun.
Figure 16:
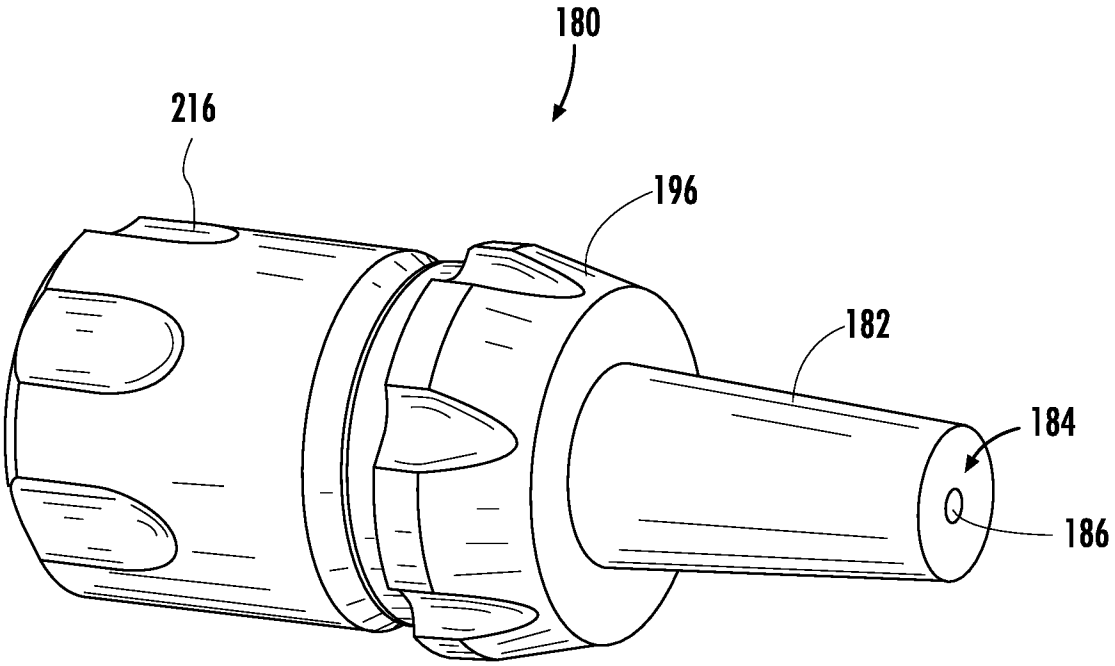
FIG. 16 is an assembled perspective view of a nozzle.
Figure 17:
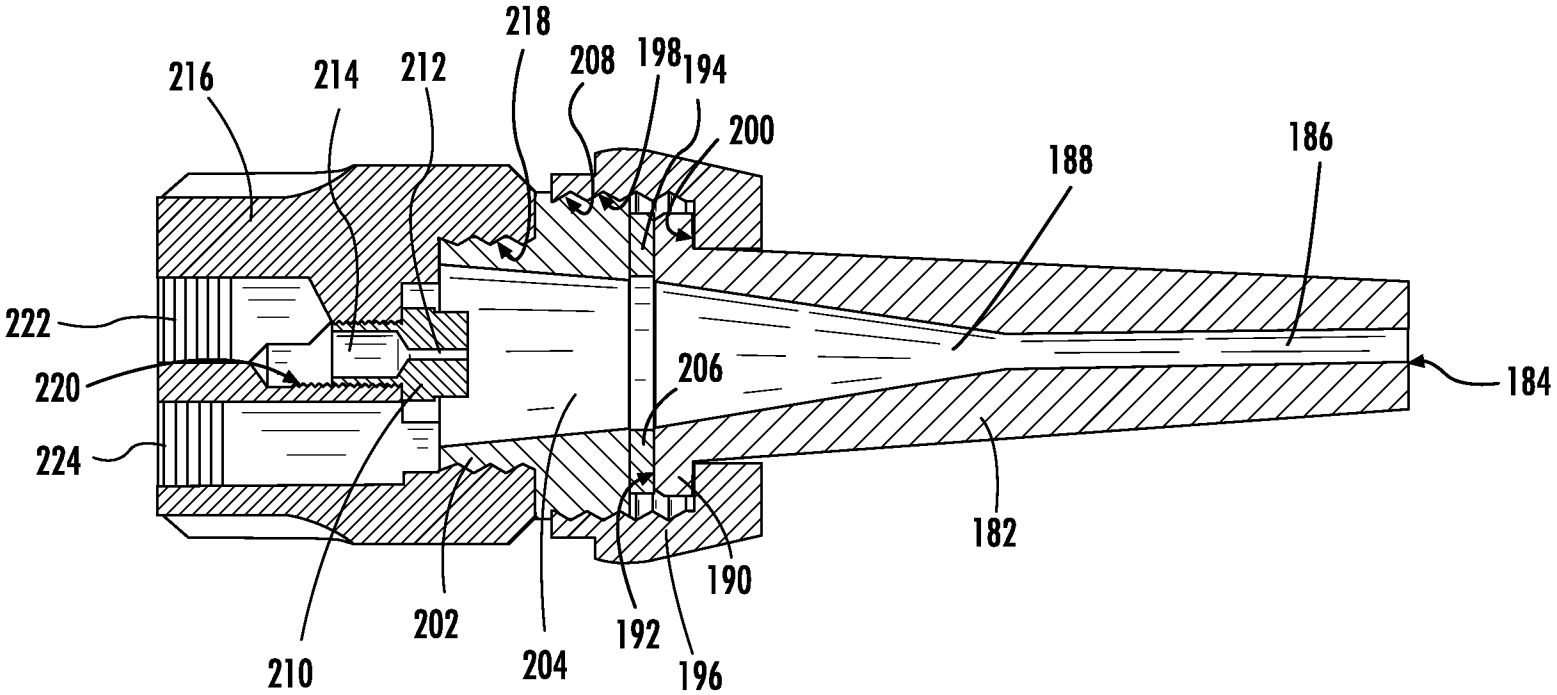
FIG. 17 is a cross-sectional view of the nozzle of FIG. 16.
Figure 18:
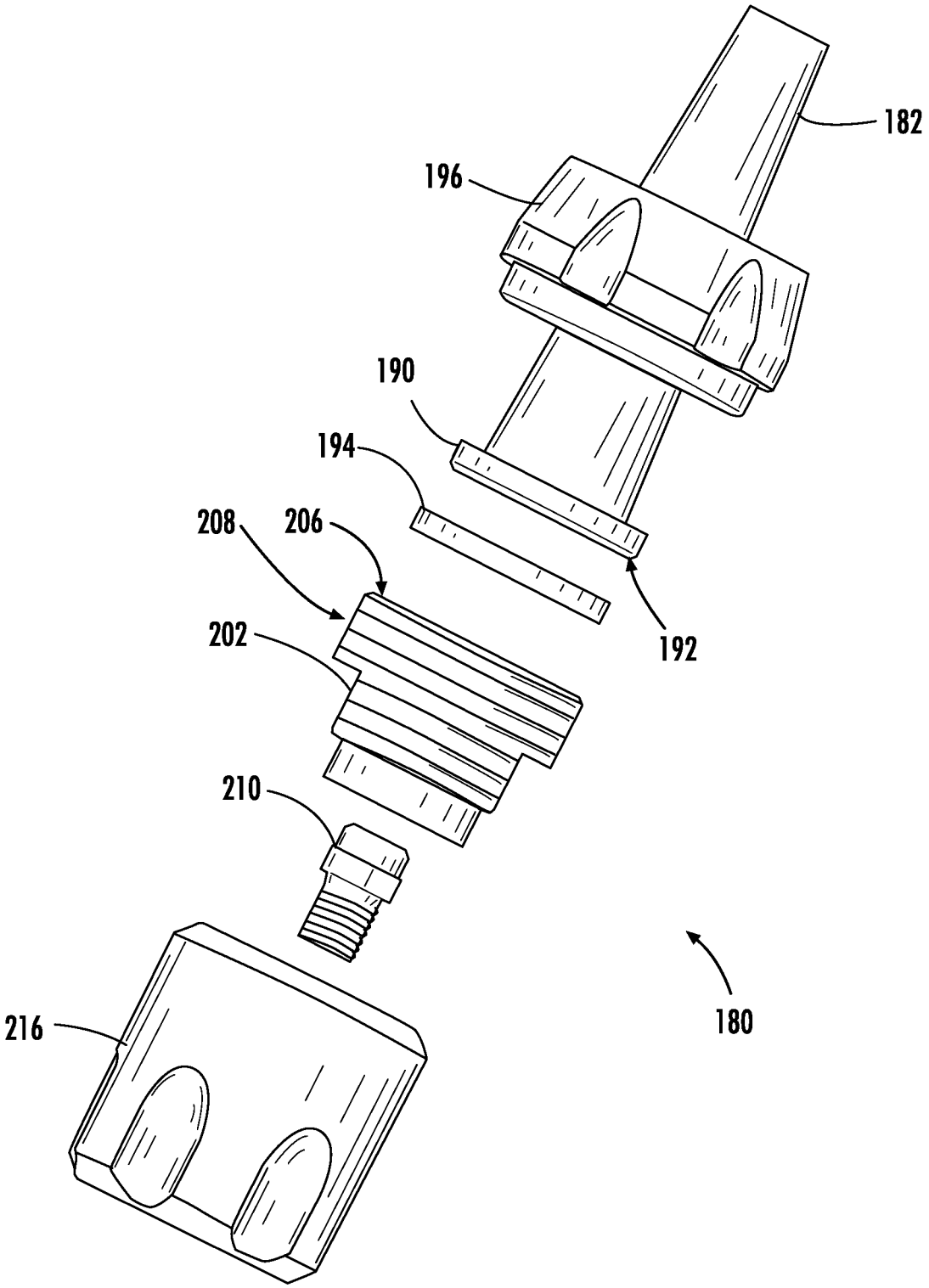
FIG. 18 is an exploded assembly view of the nozzle of FIG. 16.
Figure 19:
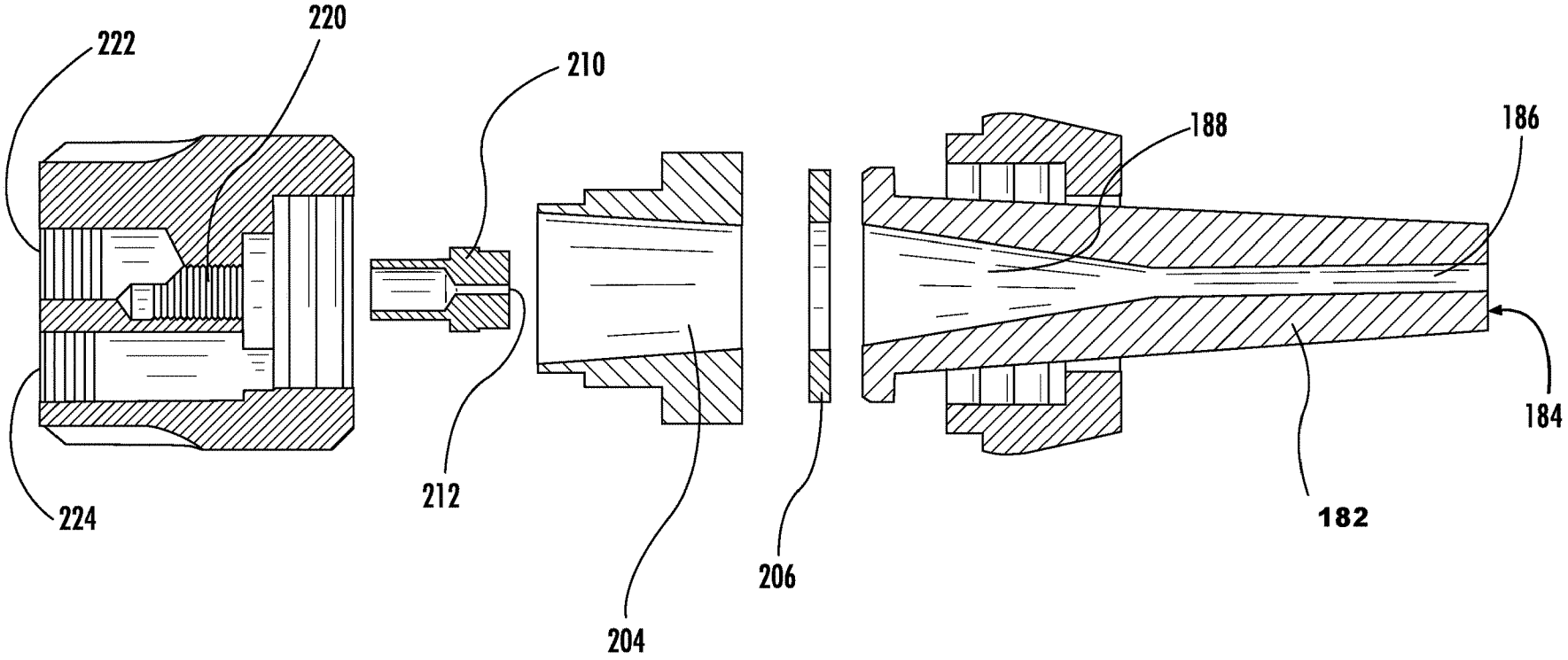
FIG. 19 is an exploded-cross-sectional view of the nozzle of FIG. 18.

The sand blaster 10 includes a gun 160, one example of which is illustrated in FIG. 15. The gun 160 is held by the user and actuated in order to dispense sand 26, air and water onto the desired surface for the treatment of the surface or for the removal of items from the surface. Air and sand 26 may enter the gun 160 through a sand air inlet 164, and water under pressure may enter the gun 160 through a water inlet 168. Combined air and sand 26 travels through the sand air inlet 164 and into a sand air line 166. With reference back to FIG. 1, a schematic drawing of the gun 160 shows the gun 160 having a water line 170. Water travels through the water line 170 when the user actuates a trigger 162 of the gun 160. If the trigger 162 is not actuated, the water will not travel through the gun 160 to the nozzle 180. Referring back to FIG. 15, the combined water, sand 26 and air is dispensed from the nozzle 180 that is at the distal end of the gun 160.

The gun 160 can be provided with a nozzle shield 172 that surrounds the nozzle 180. The nozzle shield 172 has a cone shaped aperture 174 that expands in the distal direction. The distal end of the nozzle 180 is located within the cone shaped aperture 174. The nozzle shield 172 may be constructed from a transparent plastic material and may protect the user when the user dispenses water, air, and sand 26 from the gun 160 when in close proximity to the surface being struck. It may be the case that rocks, paint chips, surface particles, sand, or other objects are deflected back to the user and strike the user such as in the hands or face of the user. The nozzle shield 172 functions to prevent this deflection back to the user by blocking the objects within the interior of the nozzle shield 172. The nozzle shield 172 is an optional feature that need not be present in other versions of the sand blaster 10.

One exemplary embodiment of the nozzle 180 is shown with reference to FIGS. 16-19. The nozzle 180 may be arranged with one or more features that minimize or eliminate wear from sand 26 traveling through the nozzle 180. The nozzle 180 includes a base 216 that has a water aperture 222 through which water under pressure enters the base 216. The base on its proximal end also has an air sand aperture 224 through which combined air and sand 26 enter the base 216. The base 216 has an aperture located within the base 216 that does not extend completely through the base 216 and that is in communication with the water aperture 222. Internal threading 220 is present on the aperture. The base 216 has another aperture that is larger than the previously discussed aperture by circumference and also does not extend all the way through the base 216. Internal threading 218 is also present in this aperture.

The nozzle 180 includes a pressure increasing member 210 that has external threading that engages internal threading 220 to cause the pressure increasing member 210 to be attached to the base 216. The pressure increasing member 210 has a proximally located large aperture 214 and a distally located small aperture 212. The apertures 214 and 212 are in fluid communication with one another and a cone shaped transition is present between the apertures 214 and 212. The large and small apertures 214 and 212 may be cylindrical in shape, and the circumference of the large aperture 214 is larger than the circumference of the small aperture 212.

An intermediate member 202 is present in the nozzle 180 and has external threading 208 that engages internal threading 218 to cause the intermediate member 202 to be attached to the base 216. The intermediate member 202 has a conical aperture 204. The conical aperture 204 is shown as not extending through the entire intermediate member 202 but the entire aperture could be conical in other arrangements. The conical aperture 204 may decrease in size in the distal direction as shown. However, other arrangements exist in which the conical aperture 204 is reversed from that shown in FIG. 17 and increases or stays substantially unchanged in size in the distal direction. In yet other arrangements, the aperture in the intermediate member 202 is not conical and, may be of any shape. The distal portion of the pressure increasing member 210 is located within the aperture of the intermediate member 202 and may be within the conical aperture 204 in some arrangements.

Water flowing through the water aperture 222 enters the large aperture 214 and then flows into the small aperture 212. The size of the flow path is decreased and the velocity of water exiting is faster at this point to increase a high pressure drop. The water will exit small aperture 212 at high velocity into the conical aperture 204. This high velocity water flow causes a vacuum to be generated that draws air and sand 26 all the way back to the air regulator 80 and hopper 52 as these components are all in fluid communication with the conical aperture 204. The air and sand 26 will mix with the water in the conical aperture 204 and be pushed forward in the distal direction of the nozzle 180.

The nozzle 180 includes a tightening member 196 with internal threading 198 along a portion of, but not all of, its inner surface. An aperture extends all the way through the tightening member 196. The internal threading 198 engages the external threading 208 to cause the tightening member 196 to engage and be attached to the intermediate member 202. As such, both the base 216 and the tightening member 196 engage the external threading 208.

The intermediate member 202 has a terminal end surface 206 located on its distal end that engages a compression member 194 which may be in the form of a gasket. The compression member 194 may be made of a material capable of being compressed and functioning as a seal. The compression member 194 may be a flat disc shaped member with a central aperture. Tightening of the tightening member 196 draws a tip 182 in the proximal direction against the terminal end surface 206 to compress the compression member 194 and form a tight engagement in the nozzle 180.

The tip 182 of the nozzle 180 has a lip 190 that has a terminal end surface 192 that is at the proximal terminal end of the tip 182 that engages the compression member 194. The tip 182 has a lip 190 that engages an internal lip engagement surface 200 of the tightening member 196. Movement of the tightening member 196 in the proximal direction causes the lip 190 to move in the proximal direction through this engagement to cause surface 192 to engage the compression member 194. The arrangement with the compression member 194 may cause the tip 182 to be more accurately aligned with the other components of the nozzle 180 to minimize wear within the nozzle 180 through sand engagement with the inner surfaces of the tip 182 and other components of the nozzle 180.

The tip 182 is open through its entire longitudinal length. A conical aperture 188 is at the proximal end of the tip 182. The conical aperture 188 decreases in size as it extends in the longitudinal direction. The conical aperture 188 is in fluid communication with a cylindrical aperture 186 that extends from the conical aperture 188 to a terminal end 184 of the tip 182. Combined air, water and sand 26 travels into and through the conical aperture 188 and then into the cylindrical aperture 186 and out of the nozzle 180 for engagement with the surface to be treated or the item to be removed.

The various components of the nozzle 180 may be made of any suitable material. The tip 182 can be made of a ceramic material and the base 216, pressure increasing member 210, intermediate member 202, and tightening member 196 may be made of a metal such as aluminum or stainless steel. The compression member 194 may be made of an elastic material such as rubber. Alignment of the various components of the nozzle 180 about a common longitudinal axis a precise amount will reduce wear of the components of the nozzle 180 from sand 26 entering and flowing through the nozzle 180.

With reference to FIG. 1, the pump 242 receives water from a water source, such as a tap water faucet. The pump 242 may pump the water through a water line 244 to the gun 160 for transfer through the water line 170. The combined sand 26 and air may travel through from the air sand conduit 58 to an air sand line 248 and then to the gun 160 for dispensing. The system may include a shut off valve 240 that is located between the air sand conduit 58 and the air sand line 248. The user may shut off the shut off valve 240 to close the shut off valve 240 to prevent sand 26 and air from being transferred into the air sand line 248. If this is done, actuation of the trigger 162 of the gun 160 will still cause water to be transferred through the gun 160 and be dispensed from the nozzle 180. In this configuration, the sand blaster 10 will function as a pressure washer as pressurized water will be dispensed from the nozzle 180 while combined sand 26 and air will not be dispensed. The shut off valve 240 thus allows the sand blaster 10 to be convertible between a sand blaster and a pressure washer by the user as desired. When used as a pressure washer, the hopper 52 may be removed along with other components such as the air sand mixer 50 and the air regulator 80 since these components are not used.

The term "sand" as used in the present application and claims is broad enough to include sand, pellets, glass beads, or any type of coarse media. It is therefore the case that the term "sand" is broad enough to include any type of abrasive media and that the sand blaster 10 can be an abrasive blaster. For sake of convenience the present application and claims have been described in terms of a sand blaster. However, the subject matter of the present application and claims is not limited to sand but can be any type of abrasive media and it is to be understood that the sand blaster is broad enough to encompass all types of abrasive blasters.

While the present invention has been described in connection with certain preferred embodiments, it is to be understood that the subject matter encompassed by way of the present invention is not to be limited to those specific embodiments. On the contrary it is intended for the subject matter of the invention to include all alternatives, modifications and equivalents as can be included within the spirit and scope of the following claims.

What is claimed:

1. A sand blaster, comprising:

a hopper configured to hold sand;

an air sand mixer that receives the sand from the hopper, wherein the air sand mixer has an air inlet through which air is transferred, wherein the air sand mixer has an air sand opening through which combined air and sand is transferred into an air sand conduit;

an air regulator that has an air inlet, wherein air is transferred from the air regulator to the air inlet of the air sand mixer, wherein the air regulator is adjustable to regulate the air flowing through the air regulator; and wherein the air regulator has a member through which at least six different sized air inlet apertures extend, wherein the air regulator has a base through which an air outlet aperture extends, wherein the member is adjustable relative to the base such that different ones of the at least sx air inlet apertures can be placed into alignment with the air outlet aperture in order to regulate the air flowing through the air regulator;

wherein the air sand mixer has a base that engages the hopper, wherein the air sand mixer has a mixing chamber spaced from the base such that a gap is present between the mixing chamber and the base through which the sand of the hopper is transferred, wherein the mixing chamber is dome shaped, wherein the air sand mixer has a vertical conduit that extends from the base into the mixing chamber and through which the air is transferred from the air inlet through the vertical conduit and then into the mixing chamber.

2. The sand blaster as set forth in claim 1, wherein the air regulator has a cover that has an air inlet, wherein the member is an intermediate member such that the intermediate member is located between the cover and the base, wherein the intermediate member rotates relative to the base about a longitudinal axis to cause the different ones of the at least six air inlet apertures of the intermediate member to be placed into and out of alignment with the air outlet aperture of the base, wherein air flows through the air inlet of the cover and into the air inlet aperture of the intermediate member and then into the air outlet aperture of the base.

3. The sand blaster as set forth in claim 2, wherein the cover, the intermediate member, and the base are all coaxial with one another, wherein the cover has a sidewall through which the air inlet of the cover extends, wherein the cover has an interior wall, wherein the intermediate member has a lower surface that faces an upper surface of the base, wherein a pair of dummy holes are defined through the base, wherein O-rings are at least partially disposed within the dummy holes and the air outlet aperture of the base, wherein the lower surface of the intermediate member engage the O-rings of the dummy holes and the air outlet aperture of the base.

4. The sand blaster as set forth in claim 1, further comprising:

a frame that carries the hopper, the air sand mixer, and the air regulator; and a plurality of elastic isolators that engage the frame, wherein the elastic isolators are located between the frame and the hopper and function to reduce vibration of the hopper, the air sand mixer, and the air regulator.

5. The sand blaster as set forth in claim 1, further comprising:

a frame;

a sliding hinge, wherein the sliding hinge has a first member in pivotal engagement with the frame, wherein the hopper has a bottom plate that engages the first member, wherein the sliding hinge has a second member in pivotal engagement with the first member, wherein the second member has a slot; and a pin that engages the frame, wherein the pin is disposed through the slot, wherein the sliding hinge is moveable from a tilted position in which the hopper, the air sand mixer, and the air regulator are tilted with respect to the frame to a non-tilted position in which the hopper, the air sand mixer, and the air regulator are not tilted with respect to the frame.

6. The sand blaster as set forth in claim 1, further comprising:

a water line through which water under pressure is transferred;

a gun that receives the water from the water line, wherein the air and sand from the air sand mixer is transferred to the gun and is dispensed with the water from the gun; and a shut-off valve located between the air sand mixer and the gun, wherein the shut-off valve is configured to shut off the air and the sand to prevent the air and the sand from being transferred to the gun from the air sand mixer, wherein when the air and the sand is prevented from being transferred to the gun the water is still capable of being dispensed from the gun such that the sand blaster functions as a pressure washer.

* * * * *